United States Patent [19]

Knabben

[11] 4,400,950

[45] Aug. 30, 1983

[54] HEATING DEVICE COMPRISING A HEAT PUMP

[76] Inventor: Heinrich Knabben, Kirchheimer Str. 16, D 7030 Böblingen, Fed. Rep. of Germany

[21] Appl. No.: 278,234

[22] Filed: Jun. 29, 1981

[30] Foreign Application Priority Data

Jun. 27, 1980 [DE] Fed. Rep. of Germany ..... 3024096
Jun. 27, 1980 [DE] Fed. Rep. of Germany ..... 3024097

[51] Int. Cl.[3] ..... F25B 27/02
[52] U.S. Cl. ..... 62/238.6; 62/296
[58] Field of Search ..... 62/296, 238.6, 238.7

[56] References Cited

U.S. PATENT DOCUMENTS

| | | | |
|---|---|---|---|
| 2,597,745 | 5/1952 | Morrison | 62/238.6 X |
| 3,187,995 | 6/1965 | Kjeldsen | 62/296 X |
| 3,785,167 | 1/1974 | Sahs | 62/296 |
| 4,073,285 | 2/1978 | Wendel | 62/238.6 X |
| 4,291,756 | 9/1981 | Bracht | 62/238.6 X |

FOREIGN PATENT DOCUMENTS

| | | | |
|---|---|---|---|
| 1093331 | 1/1981 | Canada | 62/238.6 |
| 1009203 | 5/1957 | Fed. Rep. of Germany | 62/238.6 |
| 821079 | 9/1959 | United Kingdom | 62/238.6 |
| 880093 | 10/1961 | United Kingdom | 62/238.6 |

*Primary Examiner*—Lloyd L. King
*Attorney, Agent, or Firm*—Rolf E. Schneider

[57] ABSTRACT

There is provided a heating apparatus having a heat pump including a compressor, a condenser, and an evaporator arranged in a closed circuit. A heat storage medium is contained in a storage vessel, the condenser or the evaporator being positioned therewithin. A sealed housing is disposed within the storage vessel, the compressor being positioned within the housing and rigidly connected thereto. The condenser or the evaporator is rigidly mounted to the exterior of said housing, the housing and the compressor and the condenser or the evaporator thereby forming a rigid unit. This rigid unit is resiliently mounted in the storage vessel to enable the same to be vibrated in the heat storage medium.

1 Claim, 2 Drawing Figures

HEATING DEVICE COMPRISING A HEAT PUMP

Figure 1:
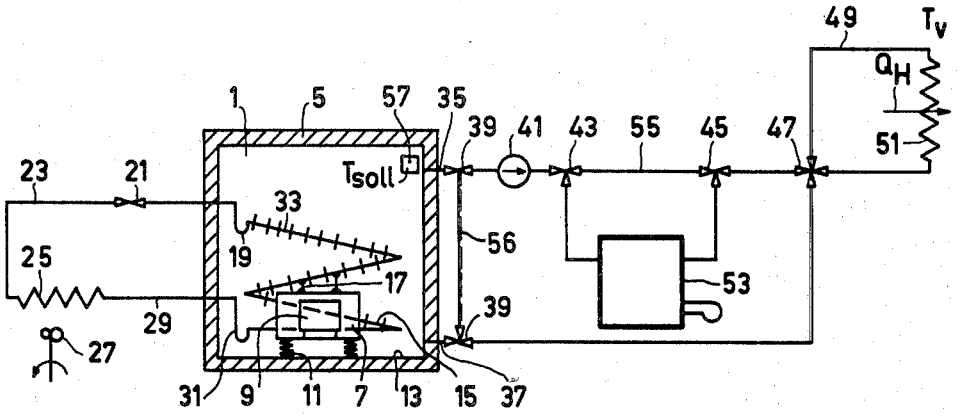

This invention relates to a heating apparatus comprising a heat pump, including a compressor, a condenser, and an evaporator arranged in a closed circuit and a storage vessel for a liquid heat storage medium, the compressor and the condenser or the evaporator being arranged or positioned inside the storage vessel and the compressor being arranged or disposed inside an enveloping housing.

Compressors used in heat pumps are customary piston-type compressors which vibrate due to the reciprocating movement of the piston. These vibrations are undesirable and can be suppressed by resiliently mounting the compressor is in a housing so that the vibrations are absorbed.

Heat pump compressors having a thermal capacity on the order of magnitude of 10 kW or less which are suitable for the heating of single family houses can usually be controlled by switching on and off. They may include a two-stage speed control system. When only small amounts of heat are required for heating during the warm seasons, frequent switching on and off of the heat pump will be unavoidable. However, because the life of a heat pump is shortened as the frequency of switching on and off is increased, attempts have been made to reduce the switching frequency by taking special steps.

Heat storage devices are known which are connected between the heat pump and the heating system. Depending on their thermal capacity, these devices considerably reduce the frequency of the switching on and off of the heat pump. Thus, a longer life of the heat pump is obtained as well as an improved efficiency throughout the year.

Also known are heat pumps which extract heat from a heat storage device. When solar energy is used as the heat source for a heat pump, a heat storage vessel is customarily included in the heat transport medium cycle of a collector or an absorber in order to compensate for the intensity of the solar radiation which strongly varies during the day.

The combination of a heat pump and a heat storage vessel, however, has the drawback that the transfer of heat between the almost stationary or only slightly moving heat storage medium in the heat storage vessel and the surface of the condenser of the heat pump is poor, because the heat storage medium heated on the surface of the condenser is not quickly displaced by cooler heat storage medium. This poor transfer of heat adversely affects the capacity of the heat pump.

The present invention has for its object to provide an apparatus or device of the described kind in which the transfer of heat between the heat transfer medium in the condenser or the evaporator and the heat storage medium in the storage vessel is improved by better contact of the heat storage medium with the wall of the condenser of the evaporator.

For a liquid heat storage medium in the storage vessel in accordance with the invention this object is achieved in that the compressor and the condenser or the evaporator are rigidly connected to the housing accommodating the compressor, said rigid unit being resiliently supported in the storage vessel so that this unit is mounted to vibrate freely in the heat storage medium in the storage vessel.

The advantage of this construction consists in that the vibrations of the piston compressor are no longer damped in the enveloping housing but instead cause vibration of the condenser or the evaporator. Such vibration leads to a more intimate contact between the outer wall of the condenser or the evaporator and the heat storage medium in the storage vessel, because the heat storage medium is put into motion. As a result, the heat storage medium can be heated more quickly or with a smaller temperature difference between the condenser or the evaporator and the contacting heat storage medium (that is to say with a higher efficiency). It is another advantage that the internal heat transfer between the heat pump transfer medium and the inner wall of the condenser or the evaporator is also improved, because the film condensation customarily taking place changes into drop condensation with an improved heat transfer under the influence of the vibrations.

There is also the advantage that the entire heat loss of the compressor is utilized in the storage vessel.

When use is made of a heat storage material which is subject to a phase change, a mechanical homogenizing device can be dispensed with.

Finally, the noise produced by the compressor in the storage vessel is strongly reduced.

Figure 2:
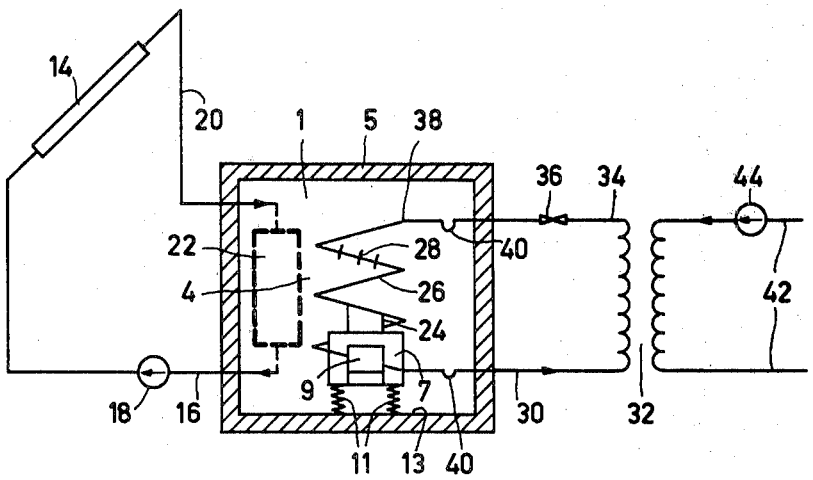

The invention will now be described in detail with reference to the accompanying drawings, in which:

FIG. 1 shows an apparatus including a heat pump for the heating of water, and FIG. 2 shows an apparatus including a heat pump for extracting heat from a storage vessel.

The central part of the apparatus shown in FIG. 1 is formed by a large storage vessel 1 in which, for example, the water of a hot water device is stored. The storage vessel may have a capacity of, for example, 1000 liters and its exterior is provided with a suitable thermal insulation 5.

In the storage vessel 1 there is arranged or disposed a hermetically sealed housing 7 in which an electric motor compressor 9 is accommodated. The motor compressor 9 is rigidly connected to the housing 7. The housing 7 is mounted on the bottom 13 of the storage vessel 1 by way of springs 11.

The compressor is connected to a condenser 15 which extends through the storage vessel 1 in a coiled manner. The condenser, being a pipe provided with fins, is rigidly connected to or mounted on the exterior of the housing 7 by way of supporting elements 17.

The heat transfer medium which arrives in the condenser 15 from the compressor 9 is discharged from the vessel 1 via a flexible connection duct 19, preferably to a thermostatically controlled expansion valve 21. Via a duct 23, the heat transfer medium flows from the expansion valve 21 to an evaporator 25. In this example, involving a bivalent heat pump installation, ambient air is blown along the evaporator, by means of a fan 27. The heat transfer medium in the evaporator then evaporates and flows to the storage vessel 1 via the duct 29. In the storage vessel 1, the duct 29 is connected to the compressor 9 via a flexible duct 31.

Because the housing 7 of the compressor 9 constitutes a rigid unit in conjunction with the condenser 15, the piston of the compressor 9 causes vibration of the unit formed by the housing 7, the compressor 9 and the condenser 15. These vibrations are transferred to the water in the storage vessel 1, because the springs enable vibration of the unit. The heat transfer between the condenser and the water in the storage vessel 1 is thus improved. The heat transfer can be further improved by providing the condenser 15 with fins 33. The improved heat transfer between the condenser 15 and the water in the storage vessel 1 enables the use of comparatively small temperature differences between the heat transfer medium and the water in the storage vessel.

On the heating side the storage vessel 1 includes a water outlet tube 35 and a water inlet tube 37. These tubes can be respectively closed by means of controllable valves 39. When the outlet valve 39 is open, the water flows from the storage vessel 1 through a pump 41, and, via the valves 43, 45, to a mixing valve 47. Depending on the position of the mixing valve, more or less water flows from the storage vessel 1 into the heating system 49 which comprises radiators 51. If the amount of heat supplied via the fan 27 is insufficient when the system is used as a bivalent heat pump installation, the compressor 9 is stopped and the heating water is heated by means of a customary boiler 53. By switching over the valves 43 and 45, the duct 55 is interrupted and the water flows from the storage vessel, via the duct 35, through the boiler 53, to the mixing valve 47 and back to the storage vessel.

The heat pump compressor 9 is controlled as follows: a thermostat 57 in the storage vessel 1 leaves the heat pump compressor 9 switched on until the required temperature $T_{soll}$ of the water in the storage vessel has been exceeded by an amount $\Delta T$. The required temperature may be dependent on external variables which determine the heat requirements of the house, for example, the ambient temperature and the incidence of solar radiation. When the said temperature is reached, the compressor is switched off. It remains switched off until the temperature of the storage vessel 1 has decreased below $T_{soll}$ due to the transfer of heat to the radiators 51. The larger the storage capacity, the smaller the number of switching cycles of the compressor 9 will be.

The required temperature $T_{soll}$ in the storage vessel 1 must be higher than or equal to the temperature $T_v$ in the heating system 49, required for supplying the heating power $Q_H$, depending on the losses between the storage vessel 1 and the radiators 51. If the capacity of the compressor is not sufficient to adapt the temperature of the water in the storage vessel to the required temperature, the existing additional heater 53 is switched on for assistance.

If the compressor must be switched off due to excessively low ambient temperatures and an excessively high power consumption of the compressor in accordance with relevant regulations, the additional heater 53 serves only for heating; the storage vessel 1 is then also suitable to act as a storage device for the additional heater. The installation operates only very slowly via the storage device. Therefore, the valves 39 may be closed and the flowing to and fro of the boiler water may take place via a bypass duct 56.

The central part of the apparatus shown in FIG. 2 is also formed by a large storage vessel 1. The storage vessel may have a capacity of, for example, 1000 liters and its exterior is provided with a suitable thermal insulation 5.

In the storage vessel 1 there is arranged a hermetically sealed housing 7 in which there is accommodated an electrically driven compressor 9. The compressor 9 is rigidly connected to the housing 7. The housing 7 is resiliently mounted on the bottom 13 of the storage vessel 1 by means of springs 11.

The heat pump serves to extract heat from a solar collector or a solar absorber 14. To this end, the storage vessel 1 includes a heat transport medium (water, a salt solution, a cooling medium, or a latent storage medium) wherefrom heat is to be extracted. The heat transport medium is pumped out of the storage vessel 1, via a duct 16, by means of a pump 18 in order to be supplied to the solar collector or absorber 14. In the collector or absorber 14, the heat transport medium is heated and returns to the storage vessel 1, via the duct 20, in which it is cooled by the evaporator of the heat pump. If the storage vessel 1 contains a heat storage medium 4 which is subject to a phase change, the heat transport medium pumped through the collector 14 gives off its heat to the heat storage medium via a heat exchanger 22 which is present in the storage vessel and which is denoted by broken lines.

The evaporator 26 is connected to or mounted on the exterior of the compressor housing 7 via fixed connections 24. Thermal energy is extracted from the storage vessel 1 in that the evaporator 26 extracts thermal energy from the heat storage medium in the storage vessel via its surface including cooling fins 28. The gas from the evaporator is compressed in the compressor 9 and is supplied from the storage vessel 1 to a condenser 32 via a duct 30. The cycle is closed in that the condensed heat transfer medium is supplied to the inlet 38 of the evaporator 26 in the storage vessel 1, via an expansion valve 36 which is preferably thermostatically controlled by means of a duct 34 which returns from the condenser. Flexible connections 40 in the ducts 30 and 34 ensure that the condenser 32 and the wall of the storage vessel 1 are not influenced by vibrations of the compressor, the housing and the evaporator. On its secondary side, the condenser 32 supplies heat to a heating system 42 in which, for example, a pump 44 circulates heating water.

Because the housing 7 of the compressor 9 is resiliently mounted on the bottom 13 of the storage vessel and because the evaporator 26 is rigidly connected to the housing 7 via the connections 24, the unit formed by the housing 7 and the evaporator 26 vibrates in the storage vessel 1. The vibrations are based on the fact that the compressor is a customary piston compressor which unavoidably produces vibrations. The vibrating of the evaporator improves the transfer of heat between the heat storage medium in the storage vessel 1 and the surface of the evaporator. The improvement in the heat transfer results in an improved efficiency of the heat pump.

What is claimed is:

1. Heating apparatus comprising a heat pump including a piston compressor, a condenser and an evaporator arranged in a closed circuit containing a heat transfer medium, the reciprocation of the piston in the compressor creating vibration; a storage vessel containing a heat storage medium, the condenser or the evaporator being positioned within the heat storage medium in said storage vessel; a sealed housing disposed within the heat storage medium in the storage vessel, the compressor being positioned within said housing and rigidly connected to the interior thereof; means to rigidly mount the condenser or the evaporator to the exterior of said housing, the housing and the compressor and the condenser or the evaporator thereby forming a rigid unit; and springs resiliently supporting said rigid unit within the storage vessel to enable the rigid unit to be freely vibrated in the heat storage medium, the resulting vibration increasing the transfer of heat to the heat storage medium.

* * * * *